US005779287A

United States Patent [19]

Johansson

[11] Patent Number: 5,779,287

[45] Date of Patent: Jul. 14, 1998

[54] LOCK HAVING AN OPTICAL BOLTING MEANS

[76] Inventor: Torsten Johansson, Köpmangatan 9, S-633 56 Eskilstuna, Sweden

[21] Appl. No.: 803,922

[22] Filed: Feb. 21, 1997

[51] Int. Cl.[6] ..... E05C 1/12

[52] U.S. Cl. ..... 292/169.14; 292/165; 292/244

[58] Field of Search ..... 292/165, 169, 292/169.14, 169.15, 359, 244

[56] References Cited

U.S. PATENT DOCUMENTS

| | | | |
|---|---|---|---|
| 2,295,435 | 9/1942 | Teich | 292/359 |
| 2,327,243 | 8/1943 | Booth | 292/165 |
| 2,386,868 | 10/1945 | Karczewski | 292/244 |
| 4,479,671 | 10/1984 | Colombo | 292/169.14 |
| 5,141,268 | 8/1992 | Keller | 292/169.14 |

*Primary Examiner*—Flemming Saether
*Attorney, Agent, or Firm*—Birch, Stewart, Kolasch & Birch, LLP

[57] ABSTRACT

A lock having an optional bolting member is described. It includes a lock case having opposed walls and a latch bolt slidable between a locking position and an unlocking position. The optional bolting member includes a holding bolt introducible through an aperture provided in at least one of the opposed walls. The holding bolt is positionable in a first, relatively retracted position allowing sliding of the latch bolt from its locking position to its unlocking position, and in a second, relatively inserted position preventing sliding of the holding bolt from its locking position to its unlocking position. The optional bolting member further includes a biasing member for yieldably retaining the holding bolt in its first and second positions.

6 Claims, 4 Drawing Sheets

LOCK HAVING AN OPTICAL BOLTING MEANS

FIELD OF THE INVENTION

The present invention concerns a lock having an optional bolting means.

More precisely, this invention concerns a lock installable in, e.g., a door leaf. The lock includes a case and a latch bolt movable within the case between a locking position, in which the latch bolt at least partly projects from the case, and an unlocking position, in which the latch bolt is retracted within the case. Generally, a lock of this kind includes some kind of bolting means adapted to bolt the latch bolt in at least its locked position. Such bolting means is factory mounted on one side of the case for access from a corresponding side of a door. Consequently, to comply with possible customer needs, it is necessary to manufacture two locks having the bolting means on opposite sides of the case.

OBJECT OF THE INVENTION

The present invention has as its object to provide a lock that in its basic version is not provided with a bolting means, but which can optionally and easily be equipped with such bolting means on at least a selective one of its opposite sides. This shall be possible without the use of any particular tools and without any particular skill.

SUMMARY OF THE INVENTION

According to the present invention, the object stated above has been achieved in that the basic version of the lock is provided on at least one of its opposed sides with an aperture. An optional holding bolt is introducible through this aperture into the case. The holding bolt is positionable in a first position, in which it does not interfere with movement of the latch bolt, and a second position, in which it interferes with movement of the latch bolt so as to prevent movement thereof towards the unlocking position. An optional retaining means is releasably mountable at the case and is adapted to yieldably retain the holding bolt in both of its positions. Preferably, the retaining means is also adapted to yieldably retain the holding bolt within the case when introduced through the aperture.

Upon introduction through an aperture into the case, the holding bolt is preferably kept within the case by means of bayonet type inter-action between the bolt and portions of the case.

BRIEF DESCRIPTION OF THE DRAWINGS

An embodiment of the present invention will now be described, reference being made to the annexed drawings, wherein.

DETAILED DESCRIPTION OF A PREFERRED EMBODIMENT

Figure 1:
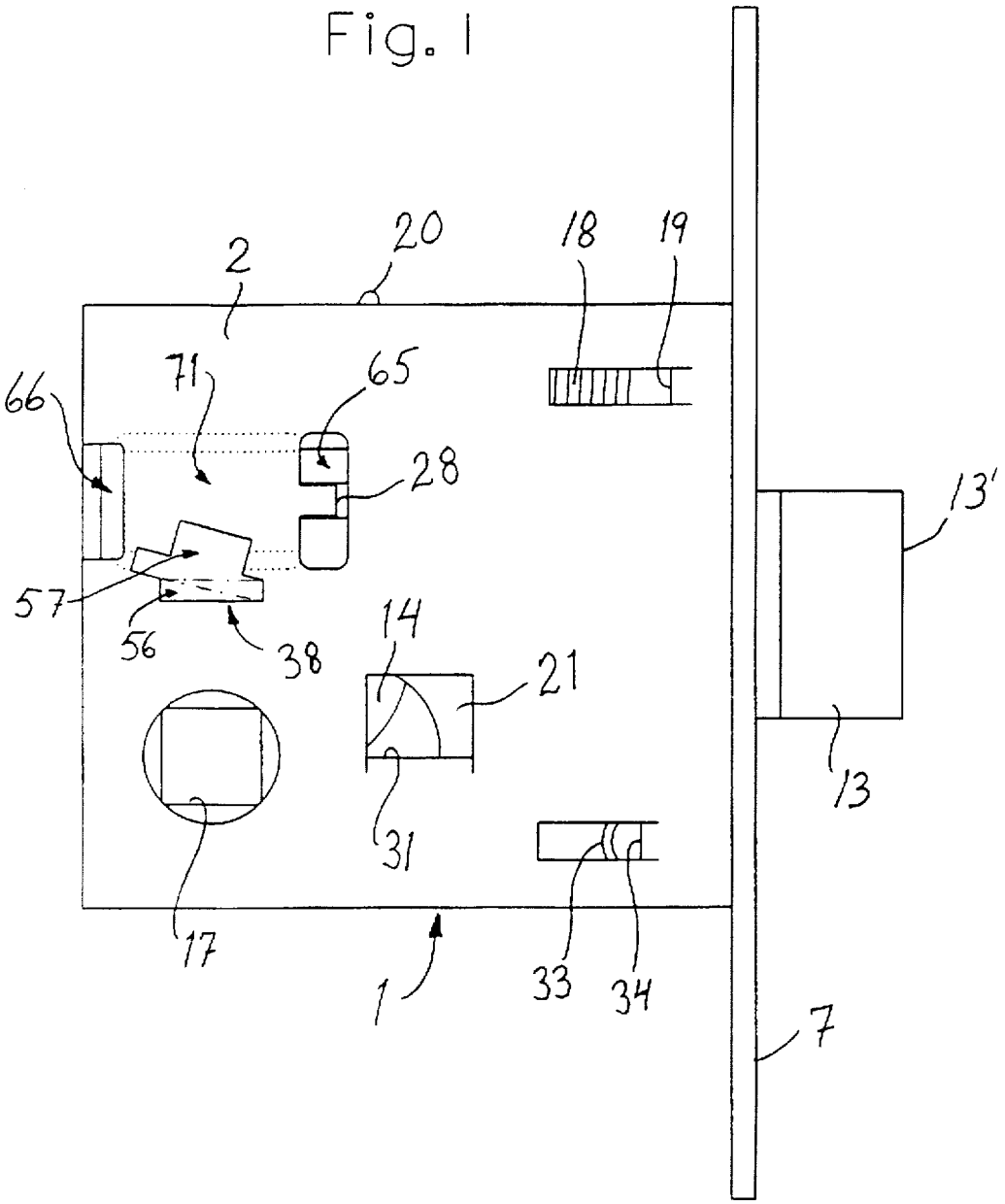
FIG. 1 is a side view of the lock seen from its right hand side.
Figure 2:
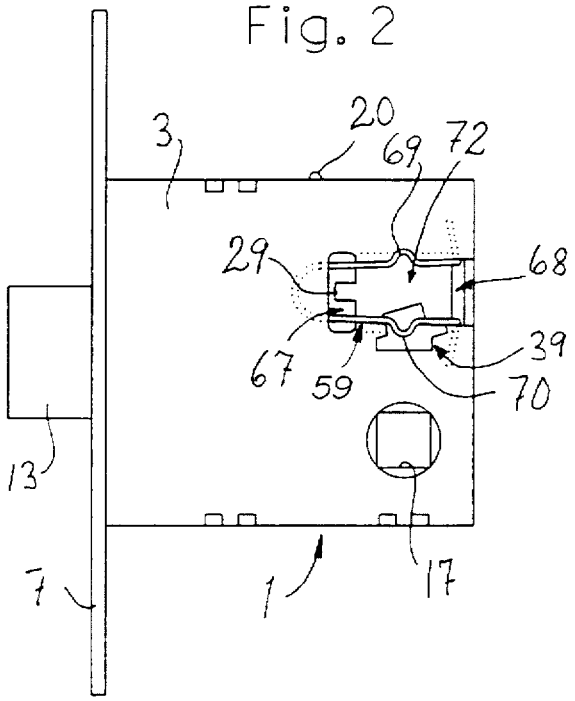
FIG. 2 is a side view of the lock at a smaller scale seen from its left hand side.
Figure 3:
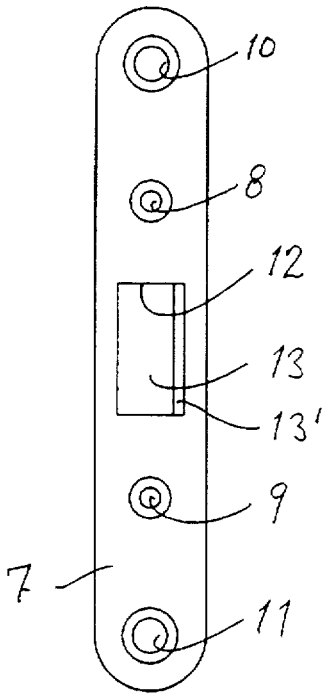
FIG. 3 is a front view of the lock of FIG. 2.
Figure 4:
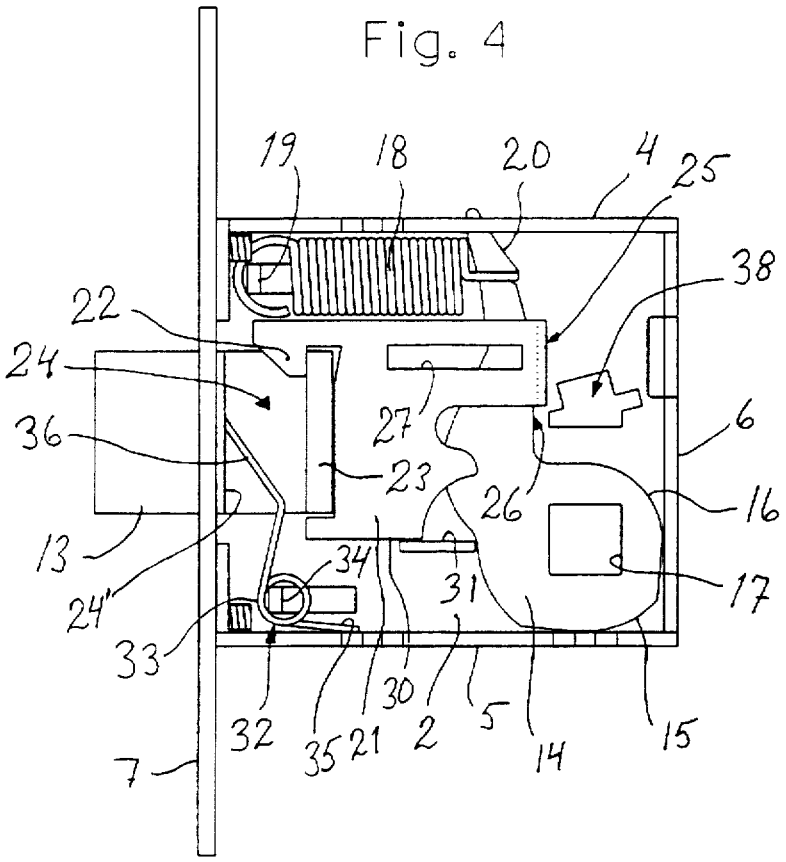
FIG. 4 is a side view of the lock seen from its left hand side at a somewhat enlarged scale in compared to FIG. 2, a side wall of the case being removed.

The lock according to the present invention has a lock case 1 including two opposed side walls 2 and 3, an upper wall 4, a lower wall 5 and a back wall 6. A forend 7 has two holes 8 and 9 for its attachment to the case, and two holes 10 and 11 for attachment of the lock to, e.g., a door leaf. The forend also has a rectangular opening 12 through which a latch bolt 13 is slidable between a locking position, in which it projects from the case, as seen in FIGS. 1, 2 and 4, and an unlocking position, in which it is retracted within the case (FIG. 5) so as to leave its front edge 13 substantially flush with the forend 7.

Figure 5:
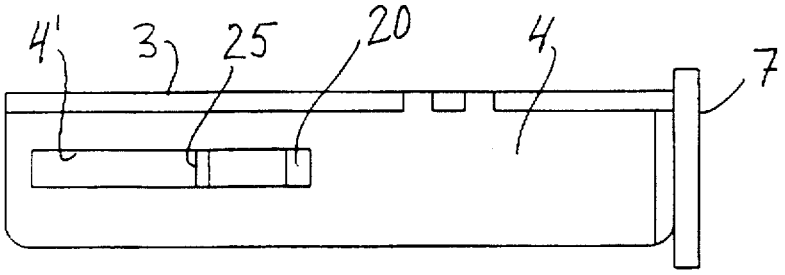
FIG. 5 is a top view of the lock.

The latch bolt is operable by means of a follower 14 located in an inner lower corner of the housing so as to be rotatable through a limit angle. A lower end of the follower has concentric arcuate peripheral portions 15 and 16 bearing on and slidable against inner surfaces of the back wall 6 and the lower wall 5, respectively. A square hole 17, the centre of which is also the centre of the arcuate peripheral portions 15, 16, is intended for insertion therein of a square rod connected to a handle for rotating the follower between the position shown in FIG. 4 to a position rotated approximately 30° to the right. On one end of a coil spring 18 is hooked a round a lug 19 bent in from the side wall 2, and the opposite end of the spring is hooked around an upper tip 20 of the follower 14 so as to urge it towards the position shown in FIG. 4. As seen in FIG. 5, the upper tip 20 is guided within a slot 4' in the upper wall 4 of the case.

An intermediate link 21 has in its forward end a hooked nose 22 gripping about a rear wall 23 of a recess 24 in the latch bolt 13. An angled portion 25 at the rear end of the intermediate link 21 grips about a substantially vertical portion 26 of the follower between its upper tip 20 and its lower portion carrying the arcuate portions 15 and 16. The intermediate link has a through slot 27 extending along an upper central portion thereof. Lugs 28 and 29 are bent in from the respective opposed side walls 2 and 3 so as to engage from either side of the intermediate link 21 in the slot 27 to guide it in its translating movements. A lower edge 30 of the intermediate link parallel to the slot 27 is guided by means of a lug 31 bent in from the side wall 2.

A helical spring 32 having its coil 33 positioned about a lug 34 bent in from the side wall 2 has one end 35 bearing on the inner side of the lower wall 5 and one end 36 bearing on a forward wall 24' of the recess 24 in the latch bolt.

As now described, the lock corresponds in all essential to any common lock of the kind at issue, and it is simply operable by rotating the follower 14 by means of a square rod connected to a handle. It is not possible, however, to bolt the latch bolt so as to prevent movement thereof towards its open position.

According to the present invention there is provided an optional bolting means for achieving such bolting. This bolting means includes a holding bolt 37 introducible through an aperture in at least one of the opposed side walls, in this preferred embodiment one aperture 38 is provided in the side wall 2 and one aperture 39 is provided in the side wall 3 and aligned with the aperture 38.

Figure 6:
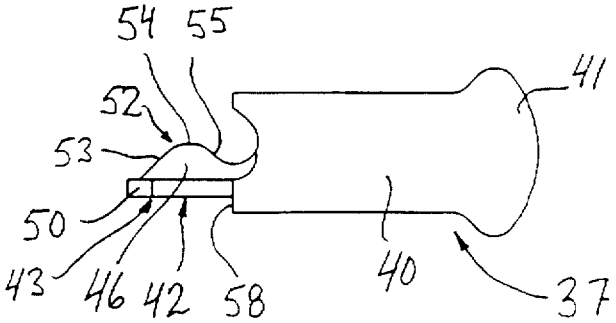
FIG. 6 is a side view at an enlarged scale of a holding bolt for use with the lock according to FIGS. 1–5.
Figure 7:
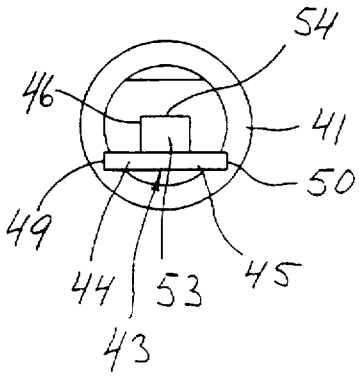
FIG. 7 is an inner-end view of the holding bolt.
Figure 8:
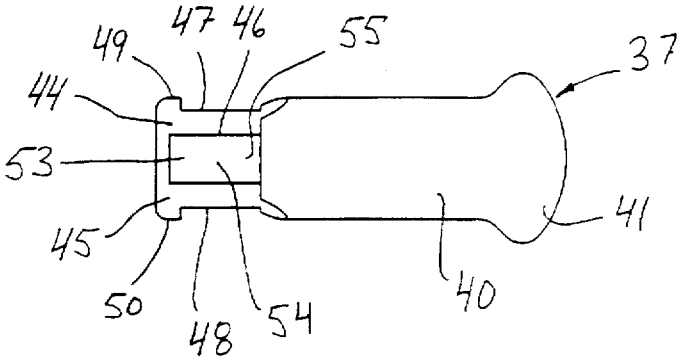
FIG. 8 is a view from above of the holding bolt.

The bolt 37 includes a substantially cylindrical handle portion 40 having a knob 41 in its outer end and being shaped in its inner or fore end (FIGS. 6, 7 and 8) for co-operation with the apertures 38, 39, and a retaining means to be described later. The cylindrical portion 40 is provided with a projection 42 having an inverted, substantially T-shaped cross section (FIG. 7) including a flat base portion 43 having flanges 44 and 45, and a web portion 46. The flanges 44, 45 have recessed portions 47, 48, respectively, along a major part of the longitudinal extension of the projection 42 (FIG. 8) starting a short distance from its foremost end, thereby leaving shoulders 49, 50, respectively, projecting in opposite directions from the front end of the knob. As illustrated in the side view of FIG. 6, the web portion 46 has the shape of a ridge 52 having a surface 53 upwardly inclining from the front end of the bolt towards an apex 54, and a surface 55 downwardly inclining towards the cylindrical portion 40 of the bolt. As will be described later, particularly the inclined surfaces 53, 55 act as cam surfaces.

To enable introduction of the bolt 37 in any one of the apertures 38, 39 and retention thereof, the apertures have the particular shapes best appearing from FIG. 1. The shape of each aperture can be considered as being composed of a lower part-aperture 56 and an upper part-aperture 57. The lower part-aperture 56 is rectangular and is dimensioned to slidably accommodate the flat base portion 43 of the projection 42 between the recessed portions 47, 48 of the flanges 44, 45. The upper part-aperture 57 has an inverted, but somewhat inclined, substantially T-shaped cross section partly overlapping the lower part-aperture 56 and corresponding to and accommodating the inverted T-shape of the projection 42 including its ridge 54 and its shoulders 49, 50.

When inserting the holding bolt 37 in one of the apertures 38, 39, it is slightly rotated (clockwise according to FIG. 1) in correspondence to the inclination of the upper part-aperture 57 (approximately 15°). Then the laterally projecting shoulders 49, 50 and the web portion 46 are introduced therethrough. As soon as the shoulders 49, 50 have passed the thickness of the wall 2, it is possible to rotate the bolt in the opposite direction (counterclockwise according to FIG. 1) and to slightly displace it laterally (to the right in FIG. 1), thereby allowing the reduced section of the projection 42 comprising the recessed portions 47, 48 of the flanges 44, 45 and the flat base portion 43 to be accommodated in the lower part-aperture 56. In that position, which is the unlocking position of the bolt, the bolt is prevented from being drawn out of the aperture 38, 39 by engagement between the shoulders 49, 50 and the inner surfaces of the wall 2, 3. Further introduction of the bolt is possible, however, until a shoulder 58 at the junction between the projection 42 and the cylindrical handle portion 40 engages the outer surface of the wall 2, 3. In that position, which is the locking position of the bolt, the web portion 46 of the projection 42 interferes its possible movement of the intermediate link 21 in its unlocking direction by engagement with the angled portion 25 of the latter.

Figure 9:
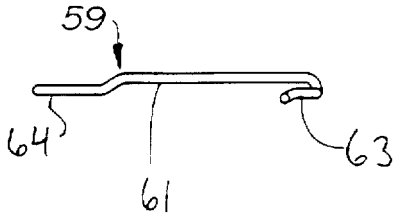
FIG. 9 is a side view of a spring used as a retaining means for the holding bolt.
Figure 10:
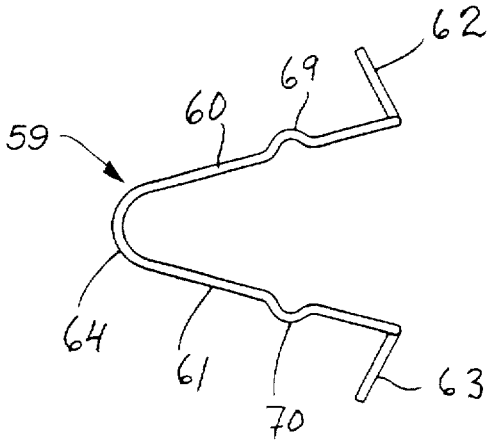
FIG. 10 is a plan view of the spring according to FIG. 9.

In order to retain the holding bolt in its unlocking position and its locking position, and also to ensure its inadvertent removal from its position in the lower part-aperture 56, there is provided a yieldable retaining means in the shape of a spring 59. As appears from FIG. 10, the spring is substantially V-shaped and includes two legs 60, 61 having angled end portions 62, 63 and an apex portion 64. As illustrated in FIG. 9, the legs are located in one plane, whereas their end portions and apex portion are located in another plane. Each side wall 2, 3 has openings 65, 66 and 67, 68, respectively, for holding the spring in its operative position. When mounting the spring in the openings 67, 68 provided in the side wall 3, as is shown in FIG. 2, the offset apex portion 64 is introduced in the opening 67 as shown with dotted lines in FIG. 2. Thereafter, the legs 60, 61 are moved together such that the likewise offset end portions 62, 63 can be introduced in the opening 68. Upon release of the spring, the legs will spring apart so that the end portions will engage under the side wall 3 at opposed ends of the opening 68 as likewise shown with dotted lines in FIG. 2. The legs are provided with outward bends 69, 70. In the position of the spring 59 shown in FIG. 2, the bend 70 is located within the aperture 39 in a position where it will ride in a camming engagement manner on the curved surfaces 53, 54, 55 of the web portion 46 with the movement of the bolt 37. More precisely, engagement between the bend 70 and the inclined surface 53 will urge the bolt towards the unlocking position, whereas engagement between the bend 70 and the inclined surface 55 will urge the bolt towards the locking direction. Consequently , the bolt 37 will yieldably be kept by the spring 59 in its locking and unlocking positions.

In order to keep the spring flush with the side walls 2 and 3, these are provided with recessed areas 71, 72 between the openings 65, 66 and 67, 68, respectively.

When mounting the optional bolting means according to the present invention, the spring 59 is first mounted as described above in a selective one of the apertures 38, 39. When thereupon introducing the bolt 37 through the aperture selected, the inclined surface 53 of the web portion 52 will engage the respective bend 69, 70 facing downwards (70 in FIG. 2) and press it upwards until the shoulders 49, 50 are located inside the respective side wall. In that position, the spring will press the bolt downwards to its operative position where the flat base portion 43 is slidingly guided within the lower part-aperture 56.

Figure 11:
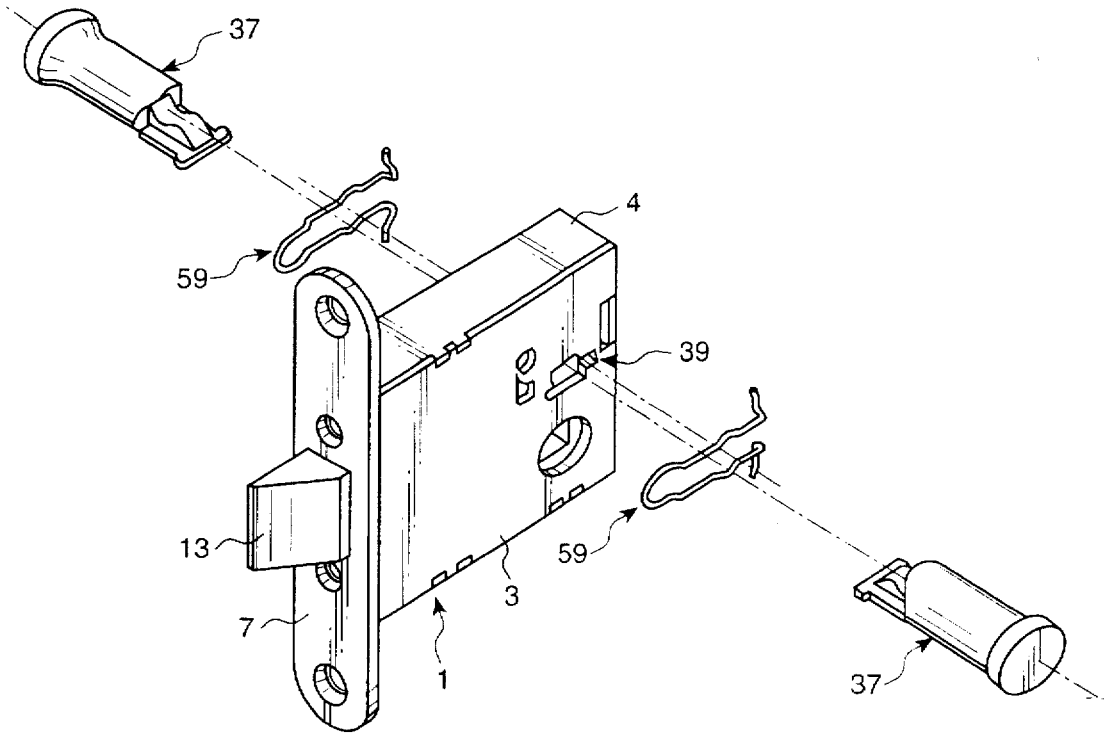
FIG. 11 is a perspective exploded view showing the relationship between the case, the holding bolt and its retaining spring in the two alternative mounting positions thereof.

As illustrated in FIG. 11, should the need arise to change the side of the lock where to have the bolt mounted, the bolt and the spring are easily removed to be remounted on the opposite side of the lock.

From the description given above it would be evident that the present invention offers a new possibility to provide a substantially ordinary lock with optional bolting means and that such bolting means is readily mounted on at least one side of the lock by mounting a spring from the outside of the case without any need to open the case, and by subsequently inserting a holding bolt as described.

I claim:

1. A bolting means for a lock comprising:

a lock case having opposed walls;

a latch bolt slidable between a locking position and an unlocking position;

a holding bolt and aperture means in said lock case for receiving said holding bolt, said holding bolt being positionable in said aperture means in a first, relatively retracted position allowing sliding of said latch bolt from said locking position to said unlocking position, and in a second, relatively inserted position preventing sliding of said holding bolt from said locking position to said unlocking position; and yieldable means for yieldably retaining said holding bolt in said first position and said second position;

wherein said aperture means includes one aperture in each of said opposed walls, and wherein releasable means is provided for releasably mounting said yieldable means adjacent a selected one of said aperture for retaining engagement with said holding bolt introduced through said selected one of said aperture.

2. The bolting means according to claim 1, wherein said aperture means and said holding bolt are shaped to provide bayonet type interlocking against unintended removal of said holding bolt from said aperture.

3. The bolting means according to claim 1, wherein said holding bolt includes cam surface means engaged by said yieldable means.

4. The bolting means according to claim 3, wherein said yieldable means is a spring bearing on portions of said holding bolt in said first position and said second position to yieldable allow shifting between said positions.

5. The bolting means according to claim 4, wherein said spring is symmetrically shaped.

6. The bolting means according to claim 5 , wherein said spring is substantially V-shaped.

* * * * *

UNITED STATES PATENT AND TRADEMARK OFFICE

CERTIFICATE OF CORRECTION

PATENT NO. : 5,779,287

DATED : July 14, 1998

INVENTOR(S) : Johansson

It is certified that error appears in the above-identified patent and that said Letters Patent is hereby corrected as shown below:

In category "[54]", please change the title of the invention from "LOCK HAVING AN OPTICAL BOLTING MEANS" to -- LOCK HAVING AN OPTIONAL BOLTING MEANS --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*